US010696914B2

(12) United States Patent
Jeon et al.

(10) Patent No.: US 10,696,914 B2
(45) Date of Patent: Jun. 30, 2020

(54) LUBRICANT BASE OIL AND METHOD FOR PREPARING THE SAME

(71) Applicants: SK Innovation Co., Ltd., Seoul (KR); SK Lubricants Co., Ltd., Seoul (KR)

(72) Inventors: Hee Jung Jeon, Daejeon (KR); Yong Woo Kim, Daejeon (KR)

(73) Assignees: SK Innovation Co., Ltd., Seoul (KR); SK Lubricants Co., Ltd., Seoul (KR)

( * ) Notice: Subject to any disclaimer, the term of this patent is extended or adjusted under 35 U.S.C. 154(b) by 0 days.

(21) Appl. No.: 16/048,925

(22) Filed: Jul. 30, 2018

(65) Prior Publication Data

US 2018/0334632 A1 Nov. 22, 2018

Related U.S. Application Data

(62) Division of application No. 14/918,051, filed on Oct. 20, 2015.

(30) Foreign Application Priority Data

Oct. 23, 2014 (KR) ..... 10-2014-0144103

(51) Int. Cl.

| | |
|---|---|
| ***C10M 105/34*** | (2006.01) |
| ***C10M 177/00*** | (2006.01) |
| ***C10M 129/70*** | (2006.01) |

(52) U.S. Cl.

CPC ..... *C10M 105/34* (2013.01); *C10M 129/70* (2013.01); *C10M 177/00* (2013.01); *C10M 2207/281* (2013.01); *C10M 2207/2815* (2013.01); *C10N 2220/022* (2013.01); *C10N 2220/10* (2013.01); *C10N 2230/02* (2013.01); *C10N 2230/70* (2013.01)

(58) Field of Classification Search

None

See application file for complete search history.

(56) References Cited

U.S. PATENT DOCUMENTS

| | | | |
|---|---|---|---|
| 2,082,790 | A | 6/1937 | Cherry |
| 2,838,480 | A | 6/1958 | Swern et al. |
| 4,892,680 | A | 1/1990 | Ishida |

FOREIGN PATENT DOCUMENTS

| | | | |
|---|---|---|---|
| CN | 1050556 | A | 4/1991 |
| CN | 101177396 | A | 5/2008 |
| DE | 908496 | C | 4/1954 |
| GB | 1282658 | | 7/1972 |
| JP | H02292395 | A | 12/1990 |

OTHER PUBLICATIONS

Rauf et al. Chinese Journal of Chemistry, 2008, 26, 699-708.*

Abdul et al: "Silica-gel-supported Phosphorus Pentoxide: a Simple and Efficient Solid-supported for Esterification of Long Chain Acids and Their Antimicrobial Screening", Chinese Journal of Chemistry, 2008, pp. 699-708, vol. 26.

Khan et al: "Design, Synthesis and In Vitro Anticancer Evaluation of a Stearic Acid-based Ester Conjugate", Anticancer Research, 2013, pp. 2517-2524, vol. 33.

* cited by examiner

*Primary Examiner* — Ana Z Muresan

(74) *Attorney, Agent, or Firm* — The Webb Law Firm

(57) ABSTRACT

The present invention relates to a lubricant base oil containing an aromatic ester lubricant represented by Chemical Formula 1 and to a method for preparing the aromatic ester lubricant. By containing an aromatic ester lubricant, the lubricant base oil exhibits an excellent dispersibility and fluidity and is ecofriendly due to a high biodegradability. In addition, the method for preparing the aromatic ester lubricant does not generate such toxic substances as S, N, aromatic compounds and heavy metals and enables an easy control of the physical properties of a desired lubricant base oil by selecting a suitable alcohol compound to be introduced for an esterification reaction.

[Chemical Formula 1]

5 Claims, 2 Drawing Sheets

LUBRICANT BASE OIL AND METHOD FOR PREPARING THE SAME

CROSS-REFERENCE TO RELATED APPLICATION

This application is a divisional of U.S. application Ser. No. 14/918,051 filed Oct. 20, 2015, which claims priority to Korean Patent Application 10-2014-0144103 filed Oct. 23, 2014, the disclosures of which are hereby incorporated by reference in their entireties.

BACKGROUND OF THE INVENTION

Field of the Invention

The present invention relates to a biomass-derived lubricant base oil and a method for preparing the same. More specifically, the present invention relates to a lubricant base oil containing an aromatic ester lubricant and a method for preparing the same.

Description of Related Art

Conventionally, the preparation of mineral oil-derived lubricant base oils required drilling of crude oil which is buried underground. From a global environmental point of view, to prepare mineral oil-derived lubricant base oils in such a manner is to add carbon buried underground to the surface circulation system of the earth. Used mineral oil-derived lubricant base oils may be removed by burning or discarded as liquid. During the course of burning, $CO_2$ is added to the surface circulation system which would otherwise not have been. When discarded as liquid, since mineral oil-derived lubricant base oils possess a very low biodegradability of about 10 to about 30% (based on the CEC analysis method), more serious problems are posed. The remainder (i.e. the portion not biodegraded) of the mineral oil-derived lubricant base oils may be absorbed into the ecosystem in the surface circulation system to cause a variety of problems. In addition, from a macroscopic point of view, the problem of serious environmental pollutants, such as sulfur (S), nitrogen (N), heavy metals, etc. present in the crude oil drilled to produce mineral oil-derived lubricant base oils, being included in the surface circulation system and causing troubles cannot be ignored.

In contrast, the problem of adding carbon in the form of $CO_2$ to the surface circulation system does not occur in the case of biomass-derived lubricant base oils, because biomass comes from animals or plants which are already present in the surface circulation system, which is to say that carbon already being circulated in the surface circulation system is utilized in this case. Since the biomass-derived lubricant base oils inherently have a biodegradability of at least about 70% or more and exhibit a biodegradability of nearly 100%, there is little negative impact posed on the ecosystem from burning or discharging into the nature the biomass fat-derived lubricant base oils which are discarded after use. Of course, toxic substances such as S, N, heavy metals, aromatics, etc. are not present throughout the preparation process.

Therefore, in order to overcome the above-described problems which the mineral oil-derived lubricant base oils have, preparation technology for a biomass-derived lubricant base oil has been proposed as a way to make an ecofriendly lubricating oil which has high biodegradability and is free of toxic substances (S, N, aromatics, heavy metals).

In addition, a lubricating oil is a physical mixture of about 80% of a base oil and about 20% of additives. As the substance which most prominently determines lubrication properties—such as viscosity, a viscosity index, a low-temperature fluidity, etc.—of a lubricating oil, a base oil has a hydrocarbon chain structure and can determine major lubrication properties by its structural regularity, molecular weight, etc. However, a lubricating oil may require alterations in the lubrication properties by small extents depending on the application, and, when the lubricating oil does not meet certain standards of lubrication properties, additives may be used to supplement any insufficient lubrication properties. Examples of such additives include a detergent, a dispersant, an antioxidant, a corrosion inhibitor, a viscosity index improver, a pour point depressant, etc. However, most of such additives include aromatic substances, etc. and thus have problems of being poorly miscible with base oils each of which makes up about 80% of a lubricating oil.

An alkyl naphthalene is introduced to the conventional lubricant base oil for improving a low-temperature fluidity and facilitating a mixing of the lubricant base oil with additives. However, alkyl naphthalenes are substances prepared as a result of bonding between alkyl groups and aromatic compounds and thus have problems of having a low biodegradability.

Therefore, the development of a lubricant base oil—which is highly biodegradable and also able to inhibit the production of additional $CO_2$ greenhouse gas and thus is ecofriendly, while also retaining the merits as a dispersant and advantages of an improved low-temperature fluidity, all of which the conventional lubricant base oils have—is immediately required.

SUMMARY OF THE INVENTION

It is an aspect of the present invention to provide a lubricant base oil that is highly mixable with additives, has an excellent fluidity and is ecofriendly due to its high biodegradability; and a method for preparing a lubricant base oil that is ecofriendly because it does not produce toxic substances such as S, N, aromatic compounds, heavy metals, etc., where the method can also enable an easy control of the physical properties of a desired lubricant base oil by selecting a suitable alcohol compound to be introduced for an esterification reaction.

One aspect of the present invention relates to a lubricant base oil. The above lubricant base oil contains an aromatic ester lubricant represented by the following Chemical Formula 1:

[Chemical Formula 1]

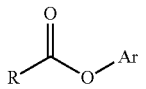

In the above Chemical Formula 1, R represents a C15-C18 alkyl group or alkenyl group, and Ar represents a phenyl group, a phenyl group substituted with a C1-C4 alkyl or C6-C10 aryl, a naphthyl group, a naphthyl group substituted with a C1-C4 alkyl or C6-C10 aryl, an anthracene group, or an anthracene group substituted with a C1-C4 alkyl or C6-C10 aryl.

In a specific example, the above aromatic ester lubricant may be represented by the following Chemical Formula 2 or Chemical Formula 3.

[Chemical Formula 2]

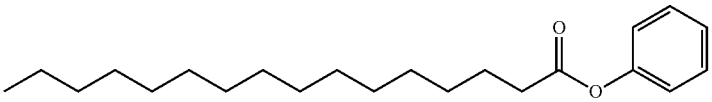

[Chemical Formula 3]

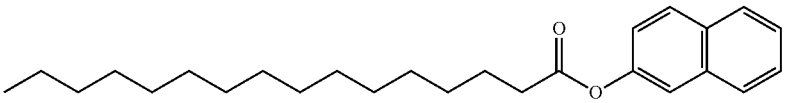

In a specific example, the content of an aromatic ester lubricant (represented by the following Chemical Formula 1) in the above lubricant base oil may be about 1 to about 40 wt %.

In a specific example, the above lubricant base oil may have a pour point of about −40 to about −5° C., viscosity (at about 100° C.) of about 3.5 to about 6.5 cSt, and a cloud point of about −40 to about −5° C.

Another aspect of the present invention relates to a method for preparing an aromatic ester lubricant. The above method includes a conversion of biomass fat to fatty acids, a separation of C16-C19 saturated fatty acids and unsaturated fatty acids from the above fatty acids, and an esterification of the above separated C16-C19 saturated fatty acids and unsaturated fatty acids with aromatic alcohol-based compounds, where the prepared aromatic ester lubricant is represented by the following Chemical Formula 1:

[Chemical Formula 1]

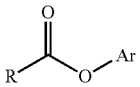

In the above Chemical Formula 1, R represents a C15-C18 alkyl group or alkenyl group, and Ar represents a phenyl group, a phenyl group substituted with a C1-C4 alkyl or C6-C10 aryl, a naphthyl group, a naphthyl group substituted with a C1-C4 alkyl or C6-C10 aryl, an anthracene group, or an anthracene group substituted with a C1-C4 alkyl or C6-C10 aryl.

In a specific example, the above esterification may refer to an esterification reaction between carboxylic groups of the above fatty acids and hydroxyl groups of the above aromatic alcohol-based compound.

In a specific example, the above aromatic alcohol-based compound may be phenol, phenol substituted with a C1-C4 alkyl or C6-C10 aryl, naphthol, naphthol substituted with a C1-C4 alkyl or C6-C10 aryl, anthracene, or anthracene substituted with a C1-C4 alkyl or C6-C10 aryl.

In a specific example, the above esterification reaction is carried out in the presence of an acid catalyst or base catalyst at a reaction temperature of about 30 to about 120° C., where the above acid catalyst may be sulfuric acid ($H_2SO_4$), perchloric acid ($HClO_4$), nitric acid ($HNO_3$), or hydrochloric acid (HCl), all of which have a purity of about 95% or more, and the above base catalyst may be potassium hydroxide (KOH), sodium hydroxide (NaOH), or sodium methoxide ($CH_3ONa$), all of which have a purity of about 95% or more.

In a specific example, the above fatty acids and above acid catalyst may be mixed in a weight ratio of about 1:about 0.01 to about 1:about 20 to be used in an esterification reaction.

DETAILED DESCRIPTION OF THE INVENTION

Figure 1:
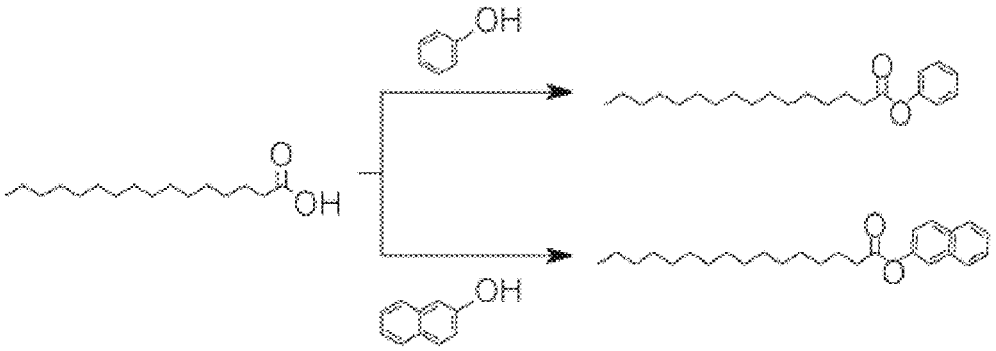
FIG. 1 schematically illustrates an esterification reaction mechanism in a method for preparing a lubricant base oil according to a specific example of the present invention.

Hereinafter, embodiments of the present invention will be described in more detail.

Lubricant Base Oil Containing Aromatic Ester Lubricant

A lubricant (lube) base oil according to a specific example of the present invention may contain an aromatic ester lubricant represented by the following Chemical Formula 1. In the present invention, a lubricant base oil is defined as an aromatic ester lubricant itself or a lubricating oil constituent containing an aromatic ester lubricant.

[Chemical Formula 1]

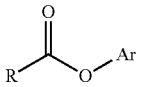

In the above Chemical Formula 1, R represents a C15-C18 alkyl group or alkenyl group, and Ar represents a phenyl group, a phenyl group substituted with a C1-C4 alkyl or C6-C10 aryl, a naphthyl group, a naphthyl group substituted with a C1-C4 alkyl or C6-C10 aryl, an anthracene group, or an anthracene group substituted with a C1-C4 alkyl or C6-C10 aryl.

The aromatic ester lubricant represented by the above Chemical Formula 1 is derived from biomass, and it can serve as both a dispersant (which can make the base oil more mixable with additives) and a pour point depressant (which can improve the fluidity by reducing the pour point) in a lubricant base oil.

As described above, the composition of a lubricant base oil of the present invention may contain an aromatic ester lubricant represented by the above Chemical Formula 1, or it may be prepared by mixing an aromatic ester lubricant represented by the above Chemical Formula 1 in a certain ratio with a conventional lubricant base oil.

Specifically, the content of an aromatic ester lubricant represented by the above Chemical Formula 1 may be about 1 to about 40 wt % with respect to the total weight of the lubricating oil composition. When the content of the aromatic ester lubricant falls in the above range, the lube base oil can be expected to have properties that meet lubricating oil property standards. When the content is higher than about 40 wt %, the viscosity and viscosity index become insufficiently low, making the lubricant base oil difficult to be used as a lubricating oil, whereas the lubrication properties and mixing properties that are unique to an aromatic ester lubricant cannot be expected with the content of less than about 1 wt %.

Specifically, the aromatic ester lubricant represented by the above Chemical Formula 1 may be an aromatic ester compound represented by the following Chemical Formula 2 or an aromatic ester compound represented by the following Chemical Formula 3. When R in the Chemical Formula 1 is such an alkyl group, a better oxidation stability can be secured.

converts the molecular structure of the fatty acids into esters through the esterification reaction between carboxylic groups of the separated fatty acids and hydroxyl groups of aromatic alcohol-based compounds.

When an ester lubricant contains a carboxylic functional group, it may cause corrosion in an engine. Therefore, stabilization of the chemical structure of the carboxylic functional group by forming an ester through an esterification reaction with an alcohol is required.

FIG. 1 illustrates the reaction mechanism of the aromatic ester lubricant according to a specific example of the present invention. Referring to FIG. 1, an example in which an aromatic ester compound is prepared by reacting each of phenol and naphthol (both of which are aromatic alcohol-based compounds) with palmitic acid (which is a C16 saturated fatty acid) is provided.

[Chemical Formula 2]

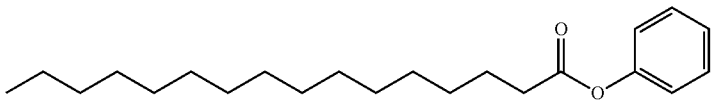

[Chemical Formula 3]

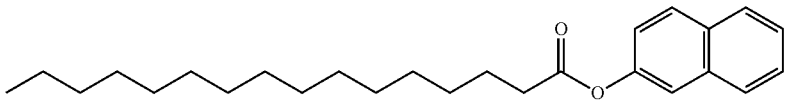

The lubricant base oil according to a specific example of the present invention may have a pour point of about −40 to about −5° C., viscosity (at about 100° C.) of about 3.5 to about 6.5 cSt and a cloud point of about −40 to about −5° C. When the properties fall in the above mentioned ranges, the lubricant base oil can be used as a viscosity index improver, pour point depressant or additive that improves mixing between the base oil and additives.

Method for Preparing Aromatic Ester Lubricant

The method for preparing an aromatic ester lubricant according to a specific example of the present invention may include a conversion S10 of biomass fat to fatty acids, a separation S20 of C16-C19 saturated fatty acids and unsaturated fatty acids from the above fatty acids, and an esterification S30 of the above separated C16-C19 saturated fatty acids and unsaturated fatty acids with aromatic alcohols.

During the conversion S10 of biomass fat to a fatty acid, as is generally known, triglycerides can be extracted from biomass by using a strong acid, a strong base, high temperature steam, etc., and the ester bonds of the above triglycerides can be hydrolyzed to be converted to fatty acids.

The separation S20 of C16-C19 saturated fatty acids and unsaturated fatty acids from the above fatty acids is required because the above biomass-derived fatty acids include a variety of saturated fatty acids and unsaturated fatty acids. For example, palm oil-derived fatty acids may include myristic acid, palmitic acid, oleic acid, linoleic acid, linolenic acid, monoglycerides, and diglycerides. Such various kinds of fatty acids have boiling points different from one another, and thus, the fatty acids of interest can be selectively separated by extraction by fractional distillation.

Therefore, C16-C19 unsaturated fatty acids may be separated by extraction from biomass-derived fatty acids through fractional distillation.

The esterification S30 of the separated saturated fatty acids and unsaturated fatty acids with aromatic alcohols There is no limitation to the aromatic alcohol-based compound to be used in an esterification reaction, as long as it is an aromatic alcohol-based compound having a hydroxyl group. Examples of such a compound include phenol, phenol substituted with a C1-C4 alkyl or C6-C10 aryl, naphthol, naphthol substituted with a C1-C4 alkyl or C6-C10 aryl, anthracene, anthracene substituted with a C1-C4 alkyl or C6-C10 aryl, and so on.

However, it may be beneficial to use low-price aromatic substances such as phenol, naphthol, etc. that are less expensive than the final product so that a volume gain effect can be expected through a preparation of esters with the use of such substances.

The above esterification reaction is carried out in the presence of an acid catalyst or base catalyst at a reaction temperature of about 30 to about 120° C., where the above acid catalyst may be sulfuric acid ($H_2SO_4$), perchloric acid ($HClO_4$), nitric acid ($HNO_3$), or hydrochloric acid (HCl), all of which have a purity of about 95% or more, and the above base catalyst may be potassium hydroxide (KOH), sodium hydroxide (NaOH), or sodium methoxide ($CH_3ONa$), all of which have a purity of about 95% or more, but they are not limited thereto.

In the above esterification reaction, the fatty acids and acid/base catalyst may be mixed in a weight ratio of about 1:about 0.01 to about 1:about 20, specifically, about 1:about 0.03 to about 1:about 20 for an esterification reaction.

Hereinafter, the present invention will be described in more detail with reference to examples, but such examples are merely for illustrative purposes and should not be construed as limiting the present invention.

Example

A. Separation of Fatty Acids

Figure 2:
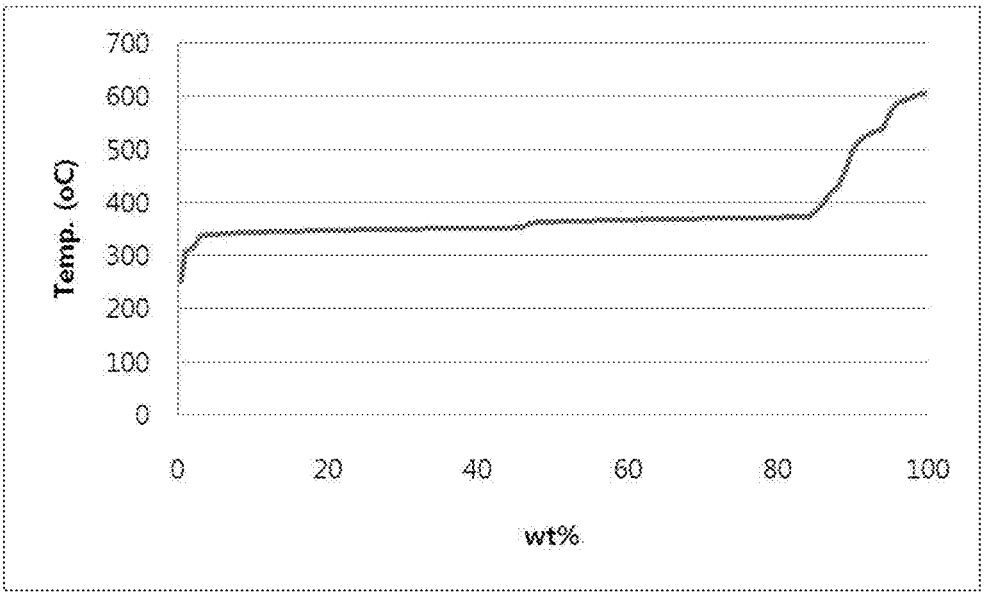
FIG. 2 is a graph illustrating the analyzed result of an example of separating fatty acids from a palm fatty acid distillate specimen at various room temperatures.

Fatty acids were separated from a 2 kg-palm fatty acid distillate (PFAD) specimen by a TBP cutting device at various reaction temperatures. The analyzed result of the above PFAD specimen is shown in FIG. 2, and, from the result, it was found that the PFAD specimen had a composition shown in the following Table 1. The PFAD specimen underwent cutting at 300° C., 355° C., 380° C., and each fatty acid was acquired in the amount shown in the following Table 2.

TABLE 1

| Type of fatty acids | PFAD composition (wt %) |
|---|---|
| Myristic acid (C14:0) | 3 |
| Palmitic acid (C16:0) | 43 |
| Oleic acid (C18:1), Linoleic acid (C18:2), Linolenic acid (C18:3) | 38 |
| Monoglyceride, diglyceride | 16 |
| Total | 100 |

B. Esterification Reaction 500 g of the PFAD separated and acquired in the composition shown in the above Table 1, as well as 292 g of 2-naphthol and 42 g of a 99% pure sulfuric acid, was introduced to a 2 L-flask, the reaction temperature was raised to 60° C., then the mixture was stirred at a speed of 200 rpm for 12 hours. Later, the above reactants were added to a 2 L-beaker and then quenched with a mixed solution of KOH/Ethanol/DI-water (38 g/100 cc/900 cc) while being stirred. The pH was measured to confirm that no residual acid was present in the above mixed solution, and then the mixed solution was set aside to wait for the temperature to decrease, added to a separatory funnel and maintained, and then, when the water layer and organic layer were separated from each other, the water layer was selectively removed. The separated organic layer was again added to the fractional distillation equipment (Spaltrohr HMS 300C by Fischer Technology, Inc.) and underwent cutting at 450° C. for a selective removal of unconsumed fatty acids and naphthol. 117 g of separated, unconsumed reactants and 629 g of the aromatic ester lubricant were acquired.

Lubricating oil properties of the above aromatic ester compound were measured, and the result is shown in the following Table 2.

TABLE 2

| Viscosity (40° C.) | Viscosity (100° C.) | Cloud point | Pour point (PP) | TAN (mgKOH/kg) |
|---|---|---|---|---|
| 48 cSt | 7.9 cSt | −36° C. | −37° C. | 0.04 |

As seen in the Table 2 above, an aromatic ester compound prepared through an example of the present invention was found to have viscosity properties and a cloud point at the levels equivalent to those of conventional dispersants such as an alkyl naphthalene and can effectively lower the pour point. In addition, the result of TAN analysis in accordance with ASTM D664 standards was 0.04 mgKOH/kg, which could be interpreted as indicating that the reactants were mostly converted to esters.

So far, examples of the present invention have been described, and it should be understood that the present invention is not limited by the above examples but can be prepared in various different forms and implemented in other specific forms by an ordinary person skilled in the art, without changing the technical scope or essential features of the present invention. Therefore, the examples described above should be understood as exemplary and non-limiting in every aspect.

The invention claimed is:

1. A method for preparing a lubricant based oil comprising 1 wt % or more and less than 40 wt % of an aromatic ester lubricant of Chemical Formula 1 below, the method comprising:

converting biomass fat to fatty acids;

separating C16-C19 saturated fatty acids and unsaturated fatty acids from the fatty acids;

esterifying the separated C16-C19 saturated fatty acids and unsaturated fatty acids with aromatic alcohol-based compounds selected from phenol, phenol substituted with a C1-C4 alkyl or C6-C10 aryl, naphthol, naphthol substituted with a C1-C4 alkyl or C6-C10 aryl, anthracene, and anthracene substituted with a C1-C4 alkyl or C6-C10 aryl, to obtain the aromatic ester lubricant of Chemical Formula 1, Chemical Formula 1

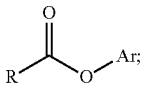

and mixing the aromatic ester lubricant with a conventional lubricant based oil, where in the above Chemical Formula 1, R represents a C15-C18 alkyl group or alkenyl group, and Ar represents a phenyl group, a phenyl group substituted with a C1-C4 alkyl or C6-C10 aryl, a naphthyl group, a naphthyl group substituted with a C1-C4 alkyl or C6-C10 aryl, an anthracene group, or an anthracene group substituted with a C1-C4 alkyl or C6-C10 aryl wherein the lubricant based oil has a pour point of −40 to −5° C., viscosity at 100° C. of 3.5 to 6.5 cSt, and a cloud point of −40 to −5° C.

2. The method of claim 1, where the esterifying refers to an esterification reaction between carboxylic groups of the fatty acids and hydroxyl groups of the aromatic alcohol-based compounds.

3. The method of claim 1, wherein each of the aromatic alcohol-based compounds includes phenol, phenol substituted with a C1-C4 alkyl or C6-C10 aryl, naphthol, naphthol substituted with a C1-C4 alkyl or C6-C10 aryl, anthracene or anthracene substituted with a C1-C4 alkyl or C6-C10 aryl.

4. The method of claim 1, wherein the esterifying is carried out in a presence of an acid catalyst or base catalyst at a reaction temperature of about 30 to about 120° C., the acid catalyst is sulfuric acid ($H_2SO_4$), perchloric acid ($HClO_4$), nitric acid ($HNO_3$), or hydrochloric acid (HCl), having a purity of about 95% or more, and the base catalyst is potassium hydroxide (KOH), sodium hydroxide (NaOH), or sodium methoxide ($CH_3ONa$), having a purity of about 95% or more.

5. The method of claim 1, wherein the fatty acids and acid catalyst are mixed in a weight ratio of about 1:about 0.01 to about 1:about 20 for the esterifying.

* * * * *